US007997033B2

(12) United States Patent
Tumlinson et al.

(10) Patent No.: US 7,997,033 B2
(45) Date of Patent: Aug. 16, 2011

(54) PULTRUDED FIBERGLASS SIGN PANEL SYSTEM

(75) Inventors: Jeff Tumlinson, Fort Worth, TX (US); Foy Barrett, Grand Prairie, TX (US)

(73) Assignee: Centerline Supply, Ltd., Grand Prairie, TX (US)

( * ) Notice: Subject to any disclaimer, the term of this patent is extended or adjusted under 35 U.S.C. 154(b) by 405 days.

(21) Appl. No.: 11/453,165

(22) Filed: Jun. 14, 2006

(65) Prior Publication Data

US 2006/0283099 A1 Dec. 21, 2006

Related U.S. Application Data

(60) Provisional application No. 60/690,260, filed on Jun. 14, 2005.

(51) Int. Cl.
*G09F 7/18* (2006.01)

(52) U.S. Cl. ..... 52/38; 52/745.02

(58) Field of Classification Search ..... 52/745.02
See application file for complete search history.

(56) References Cited

U.S. PATENT DOCUMENTS

| | | | | |
|---|---|---|---|---|
| 2,885,808 | A | 5/1959 | Bastis | |
| 3,034,806 | A | 5/1962 | Squires | |
| 3,150,455 | A * | 9/1964 | Indorf | 40/624 |
| 4,394,338 | A | 7/1983 | Fuwa | |
| 4,531,331 | A * | 7/1985 | Itagaki | 52/38 |
| 4,540,737 | A | 9/1985 | Wissbrun et al. | |
| 4,541,884 | A | 9/1985 | Cogswell et al. | |
| 4,559,262 | A | 12/1985 | Cogswell et al. | |

(Continued)

FOREIGN PATENT DOCUMENTS

| | | |
|---|---|---|
| FR | 2 678 101 | 12/1992 |

(Continued)

OTHER PUBLICATIONS

PCT Notification of Transmittal of the International Search Report and the Written Opinion of the International Searching Authority, or the Declaration dated Dec. 1, 2006.

*Primary Examiner* — Khoi Tran
*Assistant Examiner* — Jason Holloway
(74) *Attorney, Agent, or Firm* — Jackson Walker L.L.P.

(57) ABSTRACT

Pultruded fiberglass sign panels having overall and cross-section designs useful for replacing aluminum alloy highway signs are disclosed. The construction materials of the pultruded fiberglass sign panels consist of a glass roving; glass reinforcement matt; and a resin matrix. The glass content of the sign panels contain recycled or virgin glass, preferably about 16% by weight or 35% by volume of recycled or virgin glass. The resin matrix comprises thermoset isophthalic polyester that is about 42% to about 44% by weight or about 60% to about 62% by volume. The glass reinforcement matt used in the pultruded fiberglass sign panel comprises a hybrid E/A glass reinforcement matt and the pultruded fiberglass sign panel has a panel width of about 6 inches to about 36 inches, and a length of about 1 foot to about 50 feet. Two or more sign panels can be fastened together to produce a multi-panel system for making highway sign blanks. A first sign panel is fastened substantially adjacent to the second sign panel along the first or second edge forming a substantially flat sign surface on one side of the multi-panel system and a mounting surface on the opposite side of the substantially flat sign surface. The first sign panel is fastened substantially adjacent to the second sign panel using a fastener.

18 Claims, 13 Drawing Sheets

U.S. PATENT DOCUMENTS

| | | | | |
|---|---|---|---|---|
| 4,805,783 | A * | 2/1989 | Mayer | 211/94.01 |
| 5,337,502 | A | 8/1994 | Hopkins | |
| 5,811,035 | A * | 9/1998 | Mockry | 261/111 |
| 5,934,040 | A * | 8/1999 | Chen | 52/784.13 |
| 6,226,950 | B1 * | 5/2001 | Davis | 52/592.1 |
| 6,796,097 | B2 * | 9/2004 | Fensel et al. | 52/468 |
| 6,872,273 | B2 | 3/2005 | Davies et al. | |
| 2006/0288651 | A1 * | 12/2006 | Zeng et al. | 52/177 |

FOREIGN PATENT DOCUMENTS

| | | |
|---|---|---|
| GB | 1 333 582 | 10/1973 |
| WO | WO 85/05716 | 12/1985 |
| WO | WO 8505716 A1 * | 12/1985 |
| WO | WO 93/14484 | 7/1993 |

* cited by examiner

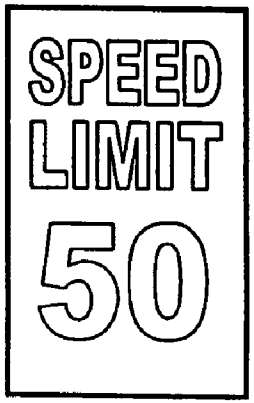
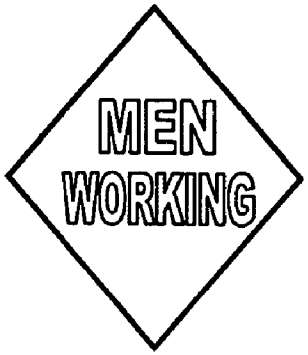
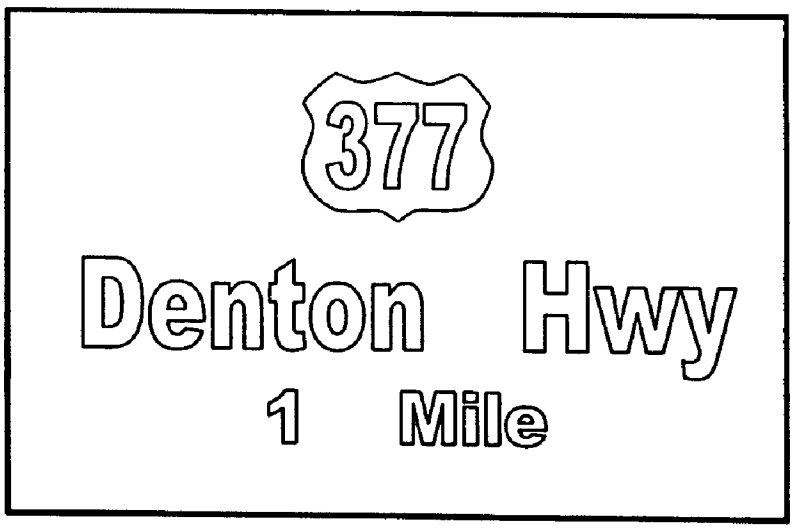
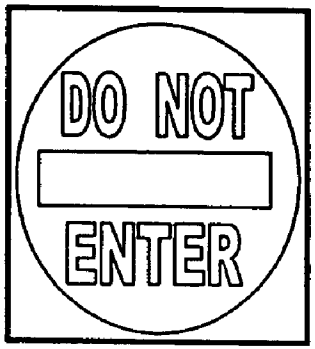
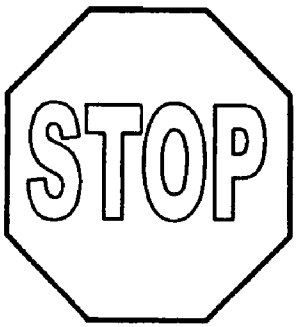
*FIG. 1*

Wind Load and Deflection Calculation

| VARIABLES | NUMERIC VALUE | ANSWERS | UNITS |
|---|---|---|---|
| S = Wind Speed | 90 | 90.000 | mph |
| E = Modulus of Elasticity | 2900000 | 2900000.000 | psi |
| Cd = Drag Coefficient, per AASHTO 1997 standard | 1.2 | 1.200 | |
| Cc = Urban Coefficient (.8), per AASHTO 1997 standard (1.2 for Sound Barriers) | 0.8 | 0.800 | |
| C = Support Edge Distance, Panel Length | 48 | 48.000 | inches |
| I = Moment of Inertia | 1.173 | 1.173 | in^4 |
| P = Wind Pressure | $.00256 \times (1.2 \times S)^2 \times Cd \times Cc$ | 33.642 | psf |
| W = Wind load | $(P \times 12.5) / 12$ | 35.044 | Lbs/lin ft. |
| □□= Deflection | $((5 \times W \times C^4) / (384 \times E \times I)) / 12$ | 0.059 | inches |

*FIG. 6*

Material Mechanical Properties

| | Uni-Directional Pultrusion Rod and Bars using uni-directional reinforcements | Multi-Directional Pultrusion Shapes using multi-directional reinforcements | Aluminum 6063-T6 | Douglas Fir (12% H20) | Rigid PVC DEONE 9700 A |
|---|---|---|---|---|---|
| Specific Gravity (LBS/Lb H20) ASTM D792 | 2.0 - 2.05 | 1.7 - 1.8 | 2.5 | 0.51 | 1.38 |
| Density (Lbs/in³) ASTM D792 | .070 .074 | .052 .058 | .092 | .02 | .052 |
| Conductivity (BTU/(°Ft/FT/hr) ASTMC177 | 5 | 4 | 1200 | .09 | 1.2 |
| Coefficient of Linear Expansion (in/in/°F) ASTM D696 | 3 x 10^-6 | 5 - 6 x 10^-6 | 13 x 10^-6 | 2 x 10^-6 | 37 x 10^-6 |
| | | | | | |
| Tensile Strength (PSI) ASTM D638 | 85K - 100K | 30K - 50K | 31,000 | 600 -1400 | 6,200 |
| Tensile- Modulus (x 10^-6 PSI) ASTM D638 | 5.0 - 6.0 | 1.8 - 3.0 | 10.0 | - | 0.39 |
| Flexural Strength (PSI) ASTM D790 | 85K - 100K | 30K - 50K | 31,000 | 1200 - 2400 | 11,000 |
| Flexural Modulus (x 10^6 PSI) ASTM D790 | 5.0 - 6.0 | 9 - 2.5 | 10.0 | 1.5 | 0.35 |
| IZOD Impact (Notched ft lbs/in) (0°C/32°F) ASTM D256 | 40 | 18 - 25 | | - | 1.6 |
| | | | | | |
| Tensile Strength (PSI) ASTM D638 | | 7K - 10K | 30,000 | 340 | 6,200 |
| Tensile- Modulus (x 10^6 PSI) ASTM D638 | | .8 - 1.4 | 10.0 | - | .039 |
| Flexural Strength (PSI) ASTM D790 | | 10K - 18K | 30,000 | - | 11,000 |
| Flexural Modulus (x 10^6 PSI) ASTM D790 | | .8 - 1.4 | 10.6 | - | 0.35 |
| IZOD Impact (Notched ft lbs/in) (0°C/32°F) | | 4 - 5 | | - | 1.0 |

FIG. 7

PULTRUDED FIBERGLASS SIGN PANEL SYSTEM

RELATED APPLICATIONS

This application claims priority to U.S. Provisional Patent Application, Ser. No. 60/690,260, entitled "A PULTRUDED FIBERGLASS SIGN PANEL SYSTEM" filed on Jun. 14, 2005, having Tumlinson and Barrett, listed as the inventor(s), the entire content of which is hereby incorporated by reference.

STATEMENT OF RIGHTS TO INVENTIONS MADE UNDER FEDERALLY SPONSORED RESEARCH

No federal grants or funds were used in the development of the present invention.

BACKGROUND

This invention relates to compositions and methods of making pultruded fiberglass sign panels, in particular, a pultruded fiberglass sign panel having an overall and cross-section designs that are useful for replacing aluminum allow highway signs. The compositions and methods of the current invention produce lighter, stronger, less expansion and contraction, and less expensive sign panels when compared to similar extruded aluminum sign panels, steel panels, or wood sign panels. Additionally, a fiberglass reinforced polymer material that useful for making sign panels can be made from recycled or virgin materials.

Highway Signs. The United States has over 6.3 million kilometers ("km") of highways crisscrossing the nation's landscape. This number includes about 4.1 million km of paved roads (including 74,406 km of expressways) and about 2.2 million km of unpaved roads. Information signage is located on nearly every kilometer of this immense network of roads, as well as roads in countries around the globe.

Many years ago, the material of choice that was used for highway signage in the United States was wood. However, since the mid 1960's, there has been a shift in the use of signage material toward the current standard of aluminum. This shift was due primarily because an aluminum sign has many superior qualities when compared to a similarly sized wood sign, including increased strength, decreased weight, and longer durability. In contrast, the disadvantages to aluminum signage is the variable cost of aluminum material itself, and the increasing cost of alodizing the aluminum alloys to increase their corrosion resistance and to improve their paint bonding qualities. For example, since 2002, the cost of aluminum has increased about 60% and the cost of Alodizing aluminum has increased more than 25%. Furthermore, aluminum has little or no resistance to impact deformation. There is a need in the highway sign industry to replacement aluminum as a choice material.

Fiberglass reinforced polymers ("FRP") are primarily made from glass and resin. Because the glass component can be made from sand or recycled glass, FRP is a much cheaper raw material than typical aluminum alloys. Additionally, a finished sign made from FRP requires fewer processing steps when compared to signs made from aluminum, which further reduces the cost of sign manufacturing.

Recycled Glass. Glass recycling has been around in the United States since glass has been used in the manufacturing of containers; for almost 100 years. Glass is one of the easiest commodities to recycle and there are many of different uses for it. In the early days and up until recently, glass bottles were returned to the company and cleaned for re-use. Today the majority of glass that is recycled is crushed and used to manufacture new containers or fiberglass insulation, as well as other secondary uses that are developing quickly.

Pultrusion. Generally, the pultrusion process is a material production process that uses continuous fiber reinforcement in roving or mat forms. The roving forms are drawn through a resin bath to coat each fiber with a resin mixture. The coated fibers are then drawn through a heated die. The cross-sectional shape of the pultrusion can be made into nearly any type of simple or complex shape, provided that the shape has a continuous cross sectional area. Cure of thermosetting resin is initiated by heat in the die and catalyst in the resin mix. The rate of reaction is controlled by heating and cooling zones in the die. The resulting high strength profile is cut to length, and typically ready to use as it leaves the pultrusion machine.

Several United States Patents, such as, U.S. Pat. Nos. 6,872,273; 4,559,262; U.S. Pat. No. 4,394,338; U.S. Pat. No. 4,540,737; and U.S. Pat. No. 4,541,884 describe in detail several known pultruding techniques, each of these patents are specifically incorporated by reference herein. More specifically, U.S. Pat. No. 4,559,262, issued to Cogswell, et al., on Dec. 17, 1985, titled "Fibre Reinforced Compositions and Methods for Producing such Compositions," ("the '262 Patent") discloses fibre-reinforced structures comprising a thermoplastics polymer and containing at least 30% by volume of reinforcing filaments extending longitudinally of the structure which have been produced in a continuous process and which have exceptionally high stiffness. The exceptionally high stiffness is a result of thorough wetting of the reinforcing filaments by molten polymer in the continuous process. The thorough wetting gives rise to a product which can be further processed even in vigorous mixing processes such as injection molding with surprisingly high retention of the fibre length in the fabricated article. The continuous processes for producing the reinforced structures employ thermoplastics polymers having lower melt viscosities than conventionally considered suitable for achieving satisfactory physical properties.

U.S. Pat. No. 4,394,338 issued to Fuwa on Jul. 19, 1983, titled "Production of Elongated Fiber-Reinforced Composite Articles," ("the '338 Patent") describes the pultrusion of a fiber-reinforced plastic, an elongated fiber material impregnated with a thermosetting resin prior to setting is introduced into a long-land die, in which a thermoplastic resin and a lubricant are successively applied onto the outer surface of the impregnated fiber material thereby to make possible smooth drawing of the material through the die. As a result, the thermosetting resin is substantially set within the die, and, moreover, an elongated, fiber-reinforced, plastic composite article is produced at a reasonable speed.

U.S. Pat. No. 4,540,737 issued to Wissbrun, et al., on Sep. 10, 1985, titled "Method for the Formation of Composite Articles Comprised of Thermotropic Liquid Crystalline Polymers and Articles Produced Thereby," (the '737 Patent") describes a method for the production of composite articles by pultrusion is provided wherein the articles comprise thermotropic liquid crystalline polymers and reinforcing fibers. The liquid crystalline polymers employed exhibit physical characteristics such that the negative slope of a dynamic viscosity-frequency curve (as defined) is less than about 0.35. The use of polymers having such rheological characteristics enables a composite material to be produced by pultrusion in which the polymer is uniformly dispersed among the reinforcing fibers.

U.S. Pat. No. 4,541,884, issued to Cogswell, et al., on Sep. 17, 1985, titled "Method of producing fibre-reinforced composition," ("the '884 Patent") describes a process of producing a fibre-reinforced composition comprising drawing a plurality of continuous filaments through a melt comprising a mixture of a thermoplastic polymer and a plasticizer for the polymer in the weight ratio between 1:4 and 99:1 of polymer to plasticizer, preferably in the weight ratio 1:1 to 19:1, the plasticizer being thermally stable at least up to the temperature of the melt and having volatility characteristics such that the plasticizer can be volatilized from the composition below the decomposition temperature of the composition but has a sufficiently low volatility at the temperature of the melt to plasticize the polymer in the melt and give a melt of reduced viscosity compared with the melt viscosity of the polymer alone. The process enables higher molecular polymers to be used in the pultrusion process and enables higher fibre contents to be achieved.

U.S. Pat. No. 6,796,097, issued to Fensel, et al., on Sep. 28, 2004, titled "Roof or Wall Panel System and Method of Installation," ("the '097 Patent") describes a light-weight structural system consisting of a panel system having at least one pair of adjacent panels and a clip positioned between the adjacent panels. A groove or channel in each panel receives an outwardly-extending tongue or tab on the clip. Built-up gussets on the panels above and below the groove or channel provide structural strength. Upwardly-extending support members on the clip bear weight from the panels. A base section of the clip allows the clip to be fixed to a roof or wall substructure. The panels can be formed from thermosetting or thermoplastic polymers, especially fiber-reinforced polymers.

U.S. Pat. No. 6,872,273, issued to Davies, et al., on Mar. 29, 2005, titled "Method of Making a Pultruded Part with a Reinforcing Mat," ("the '273 Patent") describes a method of making a pultruded part having a uniform cross-section using a novel reinforcing mat. The method comprises orienting a plurality of longitudinal rovings along a longitudinal axis of a pultrusion die; providing a reinforcing structure comprising a permeable transport web of staple fibers attached to a plurality of first reinforcing fibers oriented so that the portion of the first reinforcing fibers oriented in a direction transverse to the longitudinal axis comprises at least 40% of a volume of materials comprising the reinforcing structure; shaping the reinforcing structure to generally conform with a profile of the pultrusion die; combining a resin matrix with the longitudinal rovings and the reinforcing structure in the pultrusion die so that the longitudinal rovings and the reinforcing structure are substantially surrounded by the resin matrix; at least partially curing the resin matrix in the pultrusion die; and pulling the pultruded part from the pultrusion die.

Sign Blanks. One or more of the described fiberglass pultruded panels can be assembled together and used as sign blanks. Sign blanks are employed as the supportive backing for many different types of highway signs. Of particular interest are sign blanks that are so large that they must be formed from multiple sign blank panels. Most commonly, these large sign blanks are constructed to be employed as the backing for the large information signs used along or over highways and other roads for identifying the roads, their destinations, upcoming junctions, exits, etc, see FIG. 1. In order to construct a properly sized sign blank to receive a designated sign, sign blanks are formed from multiple aluminum sign blank panels that are bolted, riveted, or otherwise secured to each other through suitable fasteners separate and distinct from the panels themselves. The information of a sign is typically adhered to the surface of the sign blank, see FIG. 2C. Aluminum is typically used because of its light weight and weather resistance, however, the cost of processing an aluminum sign blank has continued to increase. Additionally, assembled sign blanks should have a mounting or fastening means to connect the finished information sign to a sign post. Sign panels produced form FRP are stronger, longer lasting, and cheaper to produce than the current aluminum alloy sign panels.

SUMMARY

Generally, this invention relates to compositions and methods of making pultruded fiberglass sign panels and highway sign blanks, in particular this invention pertains to a pultruded fiberglass sign panel having overall and cross-section designs that are useful for replacing aluminum alloy highway signs. The compositions and methods of the current invention produce lighter, stronger, less expansion as well as less contraction, and less expensive sign panels when compared to similar extruded aluminum sign panels or wood sign panels. Additionally, a fiberglass reinforced polymer material that is used to make the signage can utilize recycled or virgin materials.

One aspect of this invention is a multi-panel system for making a sign blank, that is comprised of a plurality of pultruded fiberglass sign panels each panel having: (a) a sign side having a substantially flat sign surface; (b) a back side having a first edge and a second edge that are parallel and located on opposite ends of the backside; (c) a first channel end protruding outward from the first edge of the backside forming an angle of about 90° with the back side, a distal end of the first channel protrusion is furthest away from the back side; (d) a second channel end protruding outward from the second edge of the backside forming an angle of about 90° with the back side, a distal end of the second channel protrusion is furthest away from the back side. The first channel end of a first sign panel is fastened substantially adjacent to a second sign panel; the two sign panels are connected lengthwise along the second edge of the first channel end and the first edge of the second channel end forming the substantially flat sign surface on the sign side of the multi-panel system and forming the mounting surface on the distal ends of the first and second channel protrusions. Mounting channel extending inwardly from the distal end of the first or second channel ends allow the assemble signed to be mounted a sign post.

In other preferred embodiments, the multi-panel system for making a sign blank also contains at least one reinforcing rib extending outwardly from the backside of the first or second sign panel. In a second preferred embodiment a first interlocking face extending outwardly from the first channel end; and a second interlocking face extending outwardly from the second channel end are used to join the panels. For example, the second interlocking face on the first sign panel can engage the first interlocking face on the second sign panel to couple the first and second sign panels together.

Additionally the current invention comprises a pultruded fiberglass sign panel having a cross-section as shown in FIG. 3B, 3C, 8A, 9A, 9B, or 10. The construction materials of the pultruded fiberglass sign panel are (a) a glass roving; (b) glass reinforcement matt; and (c) a resin matrix, and the total glass content comprises an amount of glass contained in both the glass roving and the glass reinforcement matt. In a preferred embodiment, the glass content of the pultruded fiberglass sign is about 56% to about 58% by weight or about 38% to about 40% by volume. The glass content of the pultruded fiberglass sign is in the range of about 0% to 100% recycled glass, preferably about 16% by weight or 35% by volume of recycled glass. In a second preferred embodiment, the resin matrix comprises thermoset Isophthalic polyester that is about 42% to about 44% by weight or about 60% to about 62% by volume. The resin matrix of the pultruded fiberglass sign comprises about 5% to about 50% of a recycled resin matrix, preferably about 7% by weight to about 15% by volume of a recycled resin matrix. The glass reinforcement matt used in the pultruded fiberglass sign panel comprises a hybrid E/A glass reinforcement matt. In a third preferred embodiment, the pultruded fiberglass sign panel has a panel width of about 6 inches to about 36 inches, and a length of about 1 foot to about 50 feet.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

FIG. 1 shows examples of assembled sign panels that contain roadway information;

FIG. 2A shows a perspective view of a single panel; FIG. 2B shows a perspective view of four assembled panels; FIG. 2C shows about eight assembled panels having finished information markings attached to the front of the assembled sign panels; and FIG. 2D shows a cross-section a mounting channel;

FIG. 3A show an enlarged view of the sign panel edge; FIG. 3B shows a cross-section of a pultrusion panel having two mounting channels and FIG. 3C shows a cross-section of a pultrusion panel having a single mounting channel; FIG. 3D shows a perspective view of a pultrusion panel having two mounting channels; FIG. 3E shows a perspective view of a pultrusion panel having one mounting channels;

FIG. 6 shows a table of wind load and deflection calculations including testing variables, numeric values, answers and units;

FIG. 7 shows a table having side by side comparisons of mechanical properties for five materials;

FIG. 8A shows a cross-section of an interlocking pultrusion panel having two mounting channels and FIG. 8B shows a cross-section of two interlocking pultrusion panel being joined together with the aid of the interlocking design of the panels; FIG. 8C shows a perspective view of a an interlocking pultrusion panel having two mounting channels;

FIG. 9A shows a cross-section of an interlocking pultrusion panel having two mounting channels and one full length reinforcement rib; FIG. 9B shows a cross-section of an interlocking pultrusion panel having two mounting channels and one full length reinforcement rib, and two partial length reinforcement ribs; FIG. 9C shows a perspective view of a an interlocking pultrusion panel having two mounting channels and one full length reinforcement rib; FIG. 9D shows a perspective view of a an interlocking pultrusion panel having two mounting channels and two partial length reinforcement ribs.

DETAILED DESCRIPTION

Figure 2C:
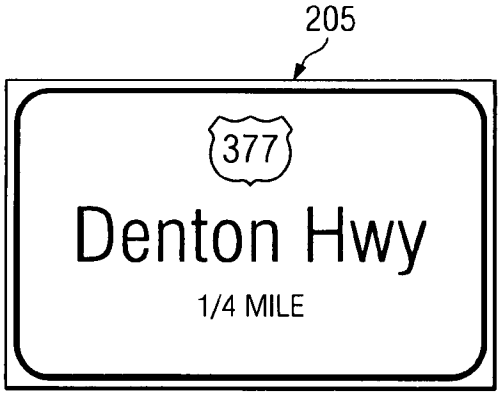
FIGS. 2A-2D show an example of assembled sign panels forming a large highway information sign.

Generally, pultrusion is a manufacturing process for producing continuous lengths of fiber reinforced polymers ("FRP") structural shapes. Raw materials include a liquid resin mixture (containing resin, fillers and specialized additives) and reinforcing fibers. The process involves pulling these raw materials (rather than pushing as is the case in extrusion) through a heated steel forming die using a continuous pulling device. The reinforcement materials are in continuous forms such as rolls of fiberglass mat or doffs of fiberglass roving. As the reinforcements are saturated with the resin mixture ("wet-out") in the resin impregnator and pulled through the die, the gelation (or hardening) of the resin is initiated by the heat from the die and a rigid, cured profile is formed that corresponds to the shape of the forming die.

While pultrusion machine design varies with part geometry, the basic pultrusion process structures contain rovings, continuous strand mat, guide plates, resin impregnators, surface veils, preformers, forming and curing dies, pulling systems and cut-off saws.

The creels position the reinforcements for subsequent feeding into the guides. The reinforcement must be located properly within the composite and controlled by the reinforcement guides.

The resin impregnator saturates (wets out) the reinforcement with a solution containing the resin, fillers, pigment, and catalyst plus any other additives required. The interior of the resin impregnator is carefully designed to optimize the "wet-out" (complete saturation) of the reinforcements.

On exiting the resin impregnator, the reinforcements are organized and positioned for the eventual placement within the cross section form by the preformer. The preformer is an array of tooling which squeezes away excess resin as the product is moving forward and gently shapes the materials prior to entering the die. In the die the thermosetting reaction is heat activated (energy is primarily supplied electrically) and the composite is cured (hardened).

On exiting the die, the cured profile is pulled to the saw for cutting to length. It is usually necessary to cool the hot part before it is gripped by the pull block (made of durable urethane foam) to prevent cracking and/or deformation by the pull blocks. There are at least two distinct pulling systems: a caterpillar counter-rotating type and a hand-over-hand reciprocating type.

In certain applications, a radio frequency ("RF") wave generator can be used to preheat the composite before entering the die. When in use, the RF heater is generally positioned between the resin impregnator and the preformer. RF is generally only used with an all roving part.

Pultruded structures are high strength components, and are typically stronger than structural steel on a pound-for-pound basis. For example, such parts have been used to form the superstructures of multistory buildings, walkways, sub-floors and platforms. Pultrusions are typically about 20-25% the weight of steel and about 70% the weight of aluminum. Pultruded products are easily transported, handled and lifted into place. Total structures can often be preassembled and shipped to the job site ready for installation. Pultruded products will not rot and are impervious to a broad range of corrosive elements. This feature makes pultrusions a natural selection for indoor or outdoor structures in pulp and paper mills, chemical plants, water and sewage treatment plants, structures near salt water and other corrosive environments.

Pultruded products are generally transparent to radio waves, microwaves and other electromagnetic frequencies. The coefficient of thermal expansion of pultruded products is slightly less than steel and significantly less than aluminum. Glass fiber reinforced pultrusions exhibit excellent mechanical properties at very low temperatures, even −70° F. Tensile strength and impact strengths are greater at −70° F. than at +80° F. Pultruded profiles are pigmented throughout the thickness of the part and can be made to virtually any desired custom color. Special surfacing veils are also available to create special surface appearances such as wood grain, marble, granite, etc. Glass reinforced pultrusions can also be manufactured from recycled glass.

Figure 2A:
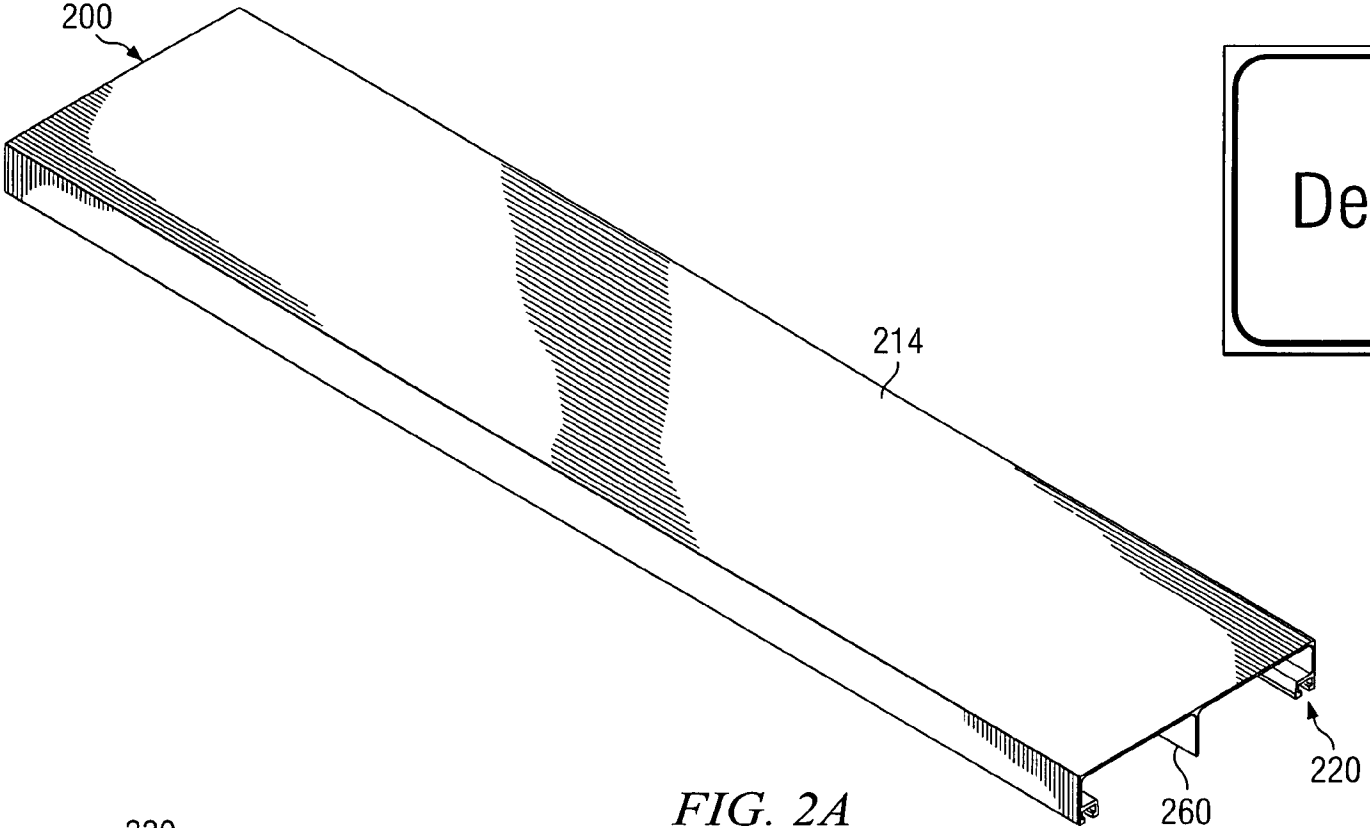
Figure 2D:
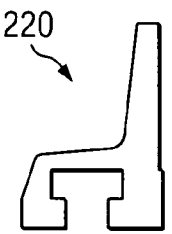
Figure 2B:
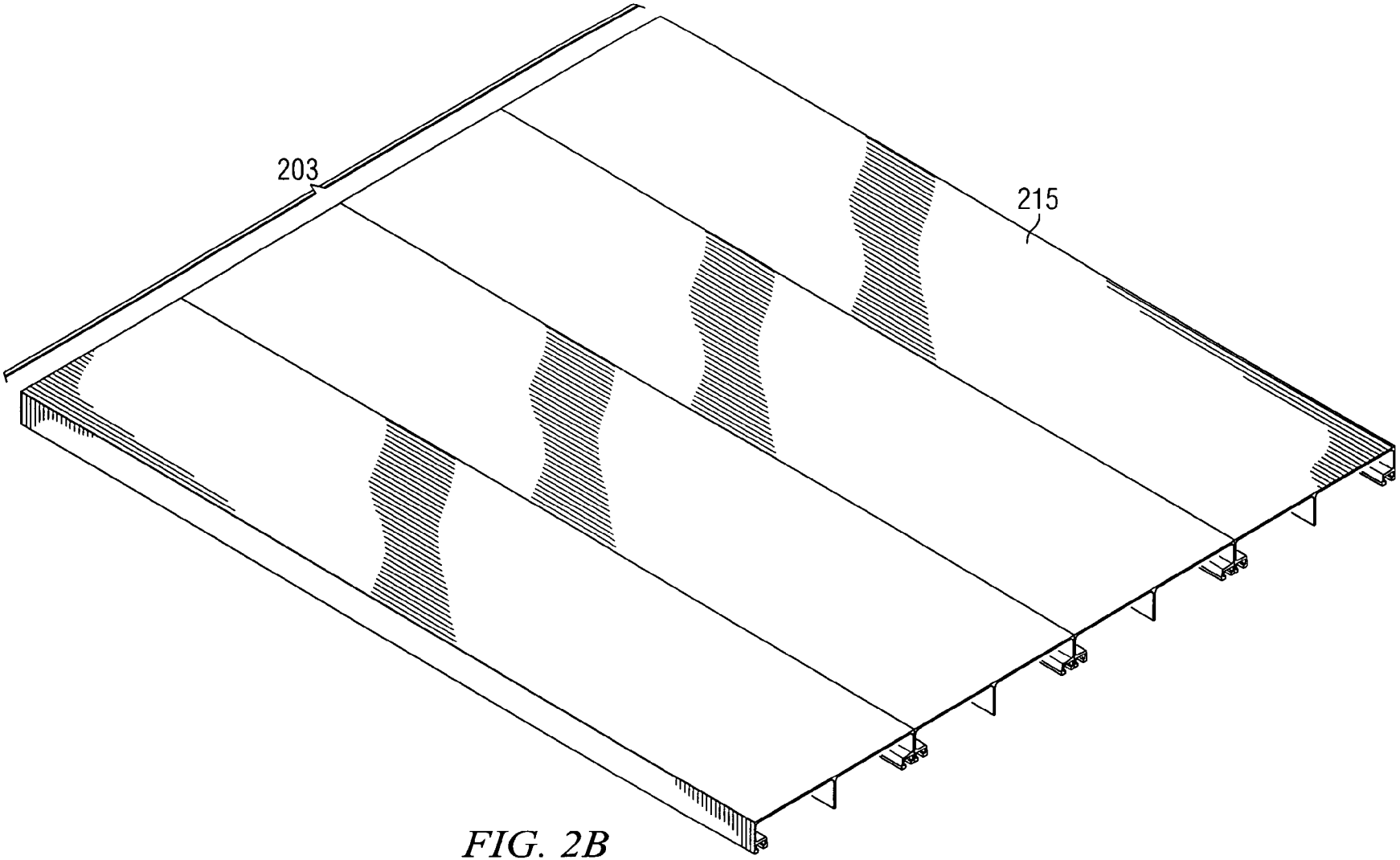

In a preferred embodiment, a FRP pultruded sign panel, as shown 200 in FIG. 2A, is one panel of the modular system for forming a sign blank in accordance with this invention. Multiple modular sign panels would be provided and joined together to form as large a sign blank as shown in 203 of FIG. 2B or completed information sign 205 of FIG. 2C.

Figure 3A:
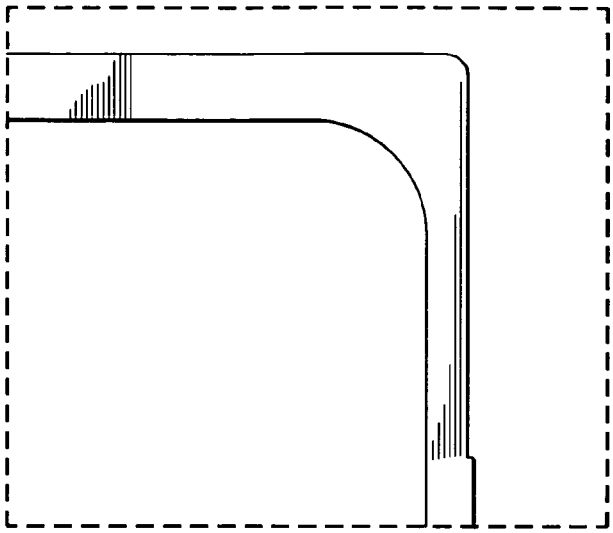
FIGS. 3A-3E show the cross-section of two different sign panels.
Figure 3B:
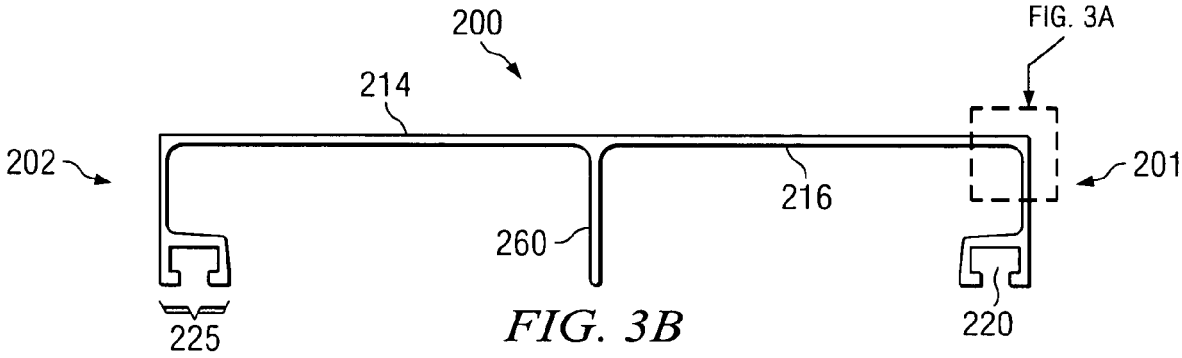
Figure 3C:
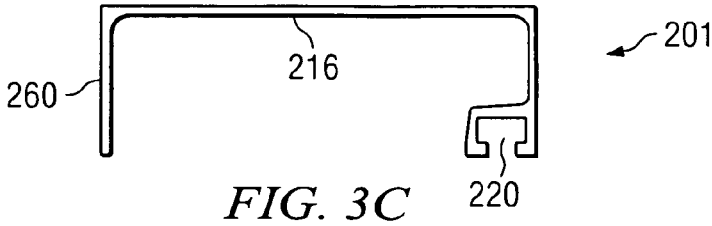
Figure 3E:
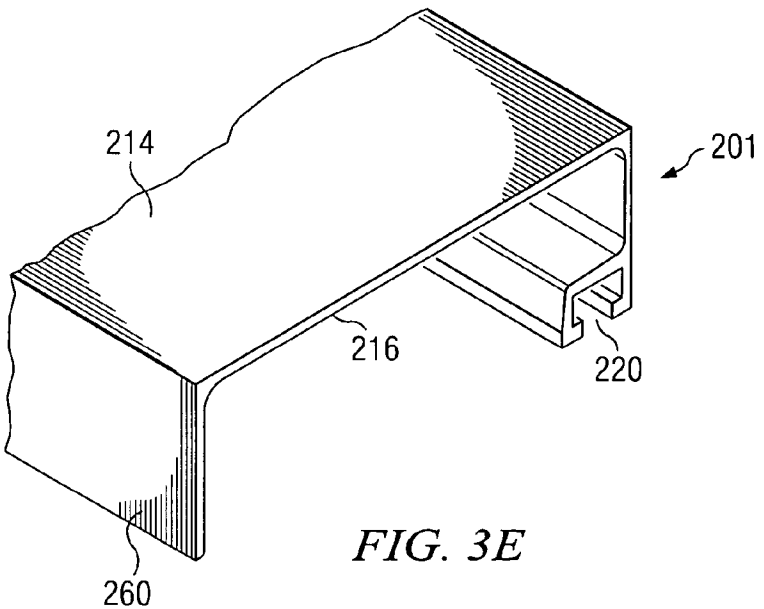
Figure 3D:
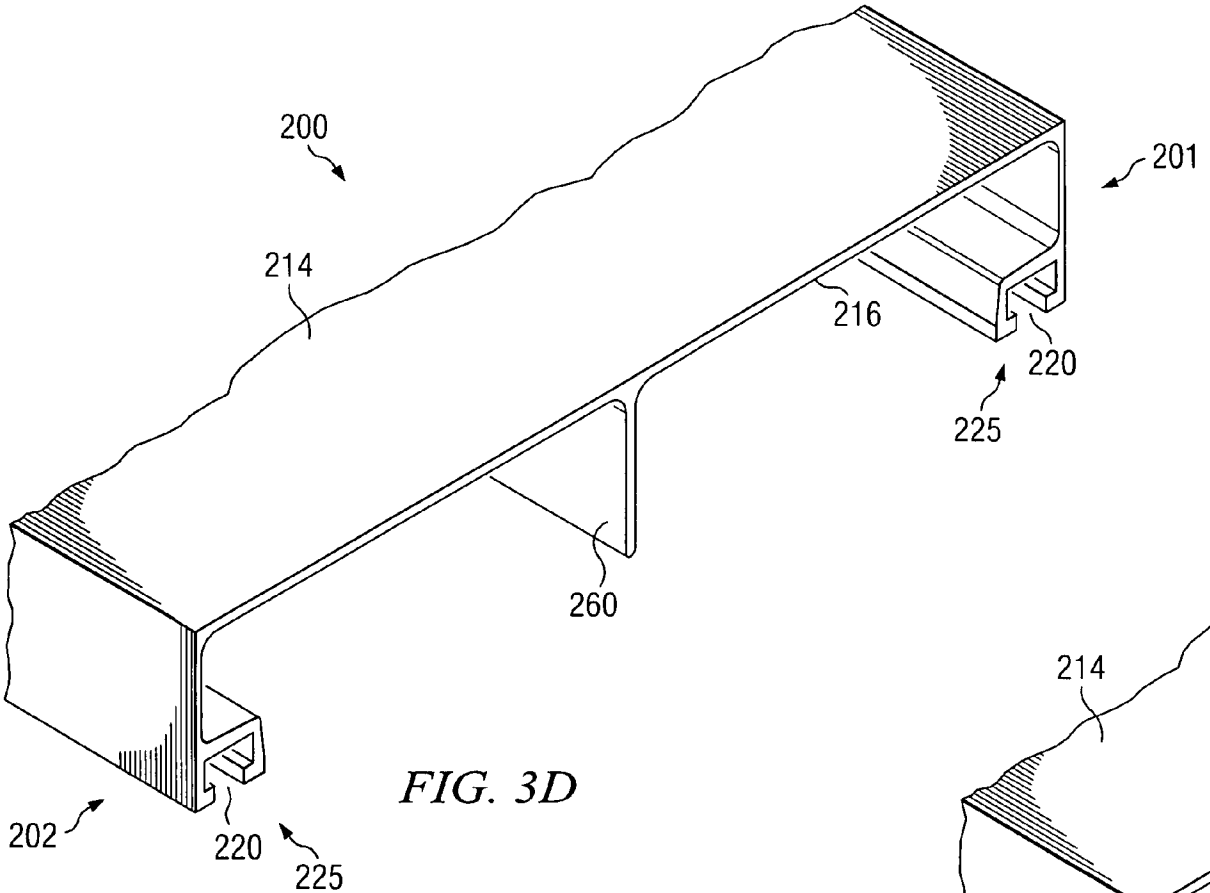

A cross section of a preferred FRP pultruded sign panel blanks can be produced in different widths. FIG. 3B shows a cross-section of a pultrusion panel having two mounting or fastener channels 220, which can be produced in different widths (e.g. 6, 12, 24 or 36 inches in width). FIG. 3A show an enlarged view of the sign panel edge. FIG. 3C shows a cross-section of a pultrusion panel having a single mounting or fastener channel 220, which also can be produced in different widths (e.g. about 3-36 inches in width). FIG. 3D shows a perspective view of a pultrusion panel having two mounting channels, and FIG. 3E shows a perspective view of a pultrusion panel having one mounting channels.

Modular panel 200 is preferably formed from resin reinforced plastic. The cross-sectional shape of modular panel 300, as seen in the figures and described herein, is achieved through a pultrusion method. The figures and the description herein are sufficient for providing those with ordinary skill in the art with enough knowledge for forming the panel through the pultrusion method, as describe above. Modular panel 200 includes face portion having sign side 214 and mounting portion having a back side 216. The back side is 216 further defined by its perimeter having a fastener channel 220. The fastener channel 220 allows the assembled sign to be fastened to a sign post or other mounting bracket for highway display. Due to this configuration, one modular panel 200 is selectively joined to another modular panel 200 by using bolts, rivets, or another means to secure one panel lengthwise to another panel forming a flat sign side, as shown in 215 in FIG. 2.

The modular panels in accordance with this invention are preferably from about 6" to about 36" inches in width from channel end 201 to channel end 202, or 203, as shown in FIGS. 3B and 3C. In a particularly preferred embodiment, modules are provided with widths at 6", 12", 24" or 36". A panel reinforcement rib 260 preferably extends at the midpoint between channel end 201 and the opposite channel end 202 or 203 to lend stability and rigidity to face portion 214.

The modular panels shown in FIG. 3C generally has a smaller dimensional with when compared to the modular panels shown in FIG. 3B. The panel of FIG. 3B differs from the panel of FIG. 3C by being smaller, having only one fastener channel 220, and does not include a panel reinforcement rib 260.

With a sign blank assembled from the modules as stated above, the sign may be completed by the attachment of a reflective coating or cover sheet upon the aligned face portions 214, or 215 of the individual or interconnected panels. Such attachment may be made by adhesive or other appropriate means. The completed sign blank is capable of being retrofit to the same fastening devices on the mounting structure as the prior art aluminum signs.

One aspect of the current invention is a multi-panel system for making a sign blank that is comprised of a plurality of pultruded fiberglass sign panels as shown in FIGS. 1, 2, 3, 8, and 9. The pultruded fiberglass sign panels having (a) a sign side [(214), (814), and (914)]; (b) a back side [(216), (816), and (916)]; (c) a first channel end [(202), (203), (802), and (902)] protruding from a first edge [(205), (805), and (905)] of the backside [(216), (816), and (916)]; (d) a second channel end [(201), (801), and (901)] protruding from a second edge [(206), (806), and (906)] of the backside; and (e) a mounting channel [(220), (820), and (920)] extending from the first channel end or second channel end. The first channel end of a first sign panel is fastened substantially adjacent to a second sign panel. The two sign panels are connected lengthwise along the second edge of the first channel end and the first edge of the second channel end forming a substantially flat sign surface on one side (215) of the multi-panel system and a mounting surface [(225), (825), and (925)] on the opposite side of the substantially flat sign surface. In other preferred embodiments, the multi-panel system for making a sign blank also contains at least one reinforcing rib [(260), (860), (960), and (918)] extending outwardly from the backside of the first or second sign panel. In a second preferred embodiment a first interlocking face [(807), (808), (907) and (908)] extending outwardly from the first channel end (902); and a second interlocking face [(809), (822), (909) and (922)] extending outwardly from the second channel end [(801), (901)] are used to join the panels (890). For example, the second interlocking face on the first sign panel can engage the first interlocking face on the second sign panel to couple the first and second sign panels together.

Additionally the current invention comprises a pultruded fiberglass sign panel having a cross-section as shown in FIG. 3B, 3C, 8A, 9A, or 9B. The construction materials of the pultruded fiberglass sign panel are (a) a glass roving; (b) glass reinforcement matt; and (c) a resin matrix, and the total glass content comprises an amount of glass Generally, the pultruded fiberglass sign panels having overall and cross-section designs are useful for replacing aluminum alloy highway signs. The construction materials of the pultruded fiberglass sign panels consist of a glass roving; glass reinforcement matt; and a resin matrix. The glass content of the sign panels contain recycled glass, preferably about 16% by weight or 35% by volume of recycled glass. The resin matrix comprises thermoset Isophthalic polyester that is about 42% to about 44% by weight or about 60% to about 62% by volume. The glass reinforcement matt used in the pultruded fiberglass sign panel comprises a hybrid E/A glass reinforcement matt and the pultruded fiberglass sign panel has a panel width of about 6 inches to about 36 inches, and a length of about 1 foot to about 50 feet. Two or more sign panels can be fastened together to produce a multi-panel system for making highway sign blanks. A first sign panel is fastened substantially adjacent to the second sign panel along the first or second edge forming a substantially flat sign surface on one side of the multi-panel system and a mounting surface on the opposite side of the substantially flat sign surface. The first sign panel is fastened substantially adjacent to the second sign panel using a fastener.

As compared to what are currently used, advantages of having the pultruded fiberglass sign panel system of the present invention include: (1) less expensive to manufacture; (2) lighter in weight; (3) more tensile strength; (4) less expansion and contraction in heat and cold; (5) more color option; and (6) utilize recycled or virgin starting material.

EXAMPLES

The following examples are provided to further illustrate this invention and the manner in which it may be carried out. It will be understood, however, that the specific details given in the examples have been chosen for purposes of illustration only and not be construed as limiting the invention.

In general, polyester resins are combined with a suitable filler, catalysts, UV inhibitors, and pigments to formulate the resinous matrix which binds the fibres together and provides the structural strength, corrosion resistance and other properties required. Although the vast majority of applications can be achieved by using the variety of polyester resins available, certain applications may require a higher strength or corrosion resistance vinylester or epoxy resin systems. Therefore, resin systems containing polyester, vinyl ester, epoxy, or silicones may also be utilized.

Fiberglass reinforced polymers ("FRP") of this invention are primarily made from glass reinforcements and resin systems. Because the glass component can be made from sand or recycled glass, FRP is a much cheaper raw material than typical aluminum alloys. However, if cost were not an important factor, other reinforcement fibers may be utilized (e.g. E-glass, S-glass, Kevlar, or graphite).

EXAMPLE 1

A fiberglass reinforced polymer ("FRP") highway panel having a cross section as shown in FIG. 3B can be produced by pultrusion using E-glass Roving, Hybrid E/A Glass Reinforcement Matt, and a Thermoset Isophthalic Polyester Resin Matrix. In the final product, the material ratios of the signs will consisted of:

Material Ratios

Glass: about 56%-58% by weight; about 38%-40% by volume;

Resin: about 44%-42% by weight; about 62%-60% by volume;

Total Part Weight: about 1.75-2.25 lbs/Ft;

Specific Gravity: about 1.8

Recycled Content in Profile

Resin Total: about 25% by weight recycled post industrial waste Polyethylene Terephthalate ("PET") 30% by Volume.

Glass Total about 100% A-Glass Reinforcement Matt Recycled Bottle Glass

In Profile

Recycled Glass: about 6.9% by Weight; about 15.2% by volume;

Recycled Resin: about 7.5% by Weight; about 14% by volume.

ExAMPLE 2

A fiberglass reinforced polymer ("FRP") highway panel having a cross section as shown in FIG. 3B can be produced by pultrusion using E-glass Roving, Hybrid E/A Glass Reinforcement Matt, and a Thermoset Isophthalic Polyester Resin Matrix. In the final product, the material ratios of the signs will consisted of:

Material Ratios

Glass: about 56%-58% by weight; about 38%-40% by volume;

Resin: about 44%-42% by weight; about 62%-60% by volume;

Total Part Weight: about 0.75-1.25 lbs/Ft;

Specific Gravity: about 1.8

Recycled Content in Profile

Resin Total: about 25% by weight recycled post industrial waste Polyethylene Terephthalate ("PET") 30% by Volume.

Glass Total about 100% A-Glass Reinforcement Matt Recycled Bottle Glass

In Profile

Recycled Glass: about 6.9% by Weight; about 15.2% by volume;

Recycled Resin: about 7.5% by Weight; about 14% by volume.

Figure 4:
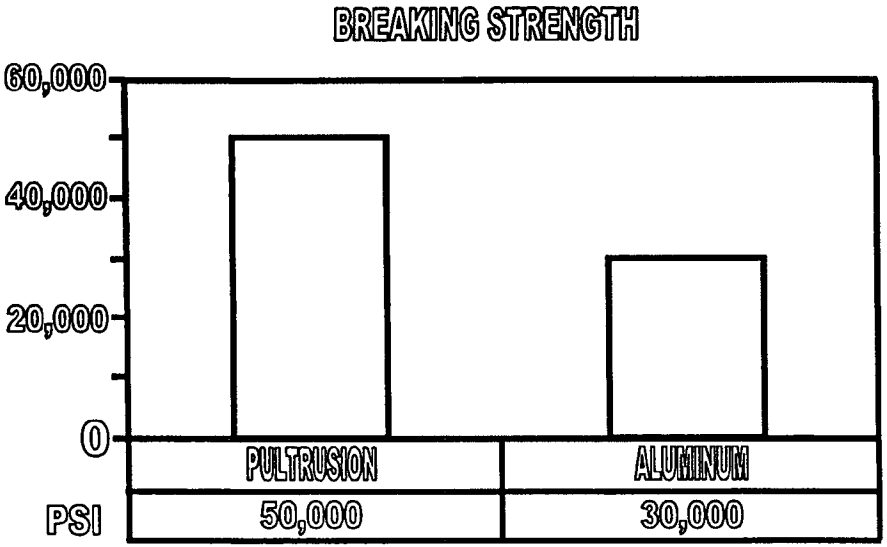
FIG. 4 shows a comparison of the breaking strength of a pultrusion panel compared with an aluminum panel.
Figure 5:
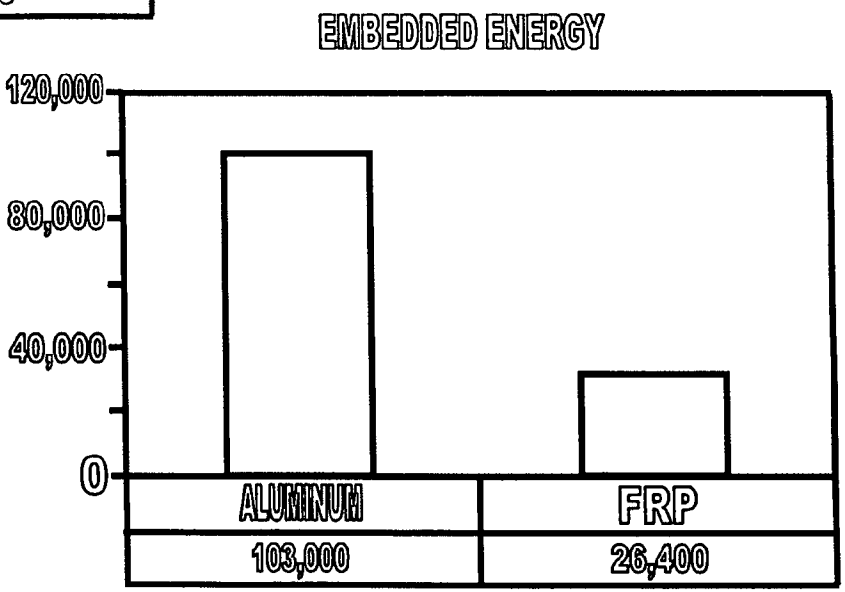
FIG. 5 shows a comparison of the embedded energy of a pultrusion panel compared with an aluminum panel.

The FRP used in this invention is stronger and lasts longer than aluminum alloys. For example, the breaking strength of a FRP product was compared to a similar aluminum alloy product in FIG. 4. The aluminum product failed at 30,000 psi, in contrast and the pultruded product required nearly 50,000 psi before failing. Additionally, the embedded energy, which is an assessment that includes the energy required to extract raw materials from nature, plus the energy used in primary and secondary manufacturing activities to provide a finished product, is higher for aluminum than an FRP. For example, FIG. 5 shows the embedded energy for aluminum is about 103,000 compared with only 26,400 for the FRP.

Wind load and deflection calculations are indicated in FIG. 6. Additionally, the mechanical properties are compared in 5 different materials in FIG. 7. For example, the tensile strength and flexural strength of a uni-directional pultrusion based product having uni-directional reinforcements are about 3 times higher (i.e. about 100 K PSI compared to about 31 K PSI respectively) when compared to a similar product made from aluminum. The advantages of fiberglass reinforced polymer sign panels over those made from aluminum alloy, wood, or PVC are many folds. Among the advantages of a fiberglass reinforced polymer sign panel are: (1) More tensile strength than sign panels made from other materials; (2) less expansion and contraction than sign panel made from a metal or an alloy; (3) lighter in weight than sign panels made from other materials; (4) recyclable; (5) can be made from recycled materials; and (6) more color options.

Veils. Generally, pultrusion is low-pressure process and fibre glass reinforcements can find their way close to the surface of the part. These can affect the appearance and corrosion resistance or the handling of the products. Fibreglass and/or polymeric veils can be added to the laminate construction to depress the glass reinforcement from the surface and thereby provide a resin rich surface to the part. The most commonly used veil is a Dacron polyester with no binders. The use of veils can improve weatherability and corrosion resistance and it is also claimed to increase die life and production speed. Veils also minimize exposing glass fibres after long term erosion of the surface resin layer.

Chemical Resistance. Pultrusions products are generally outstanding in their resistance to a wide range of organic and inorganic substances. However, the specific resin and fibre system should be considered if a corrosion resistant product is necessary.

Weatherability. UV stabilizers may be added to the resin system to retard the affect of outdoor weathering. Veils improve weatherability but for many applications the best solution is a urethane coating. Urethane coating is a method for retaining surface appearance and properties during outdoor exposure. A two component urethane coating (approx. 0.04 mm thick) can provide outdoor protection for many years with minimal change in appearance. This is applied as a secondary operation and can shield all parts of the pultruded product from UV degradation. Urethane coatings are also beneficial in providing uniformity of color and for providing a range of colors in a relatively low volume operation.

EXAMPLE 3

Figure 8A:
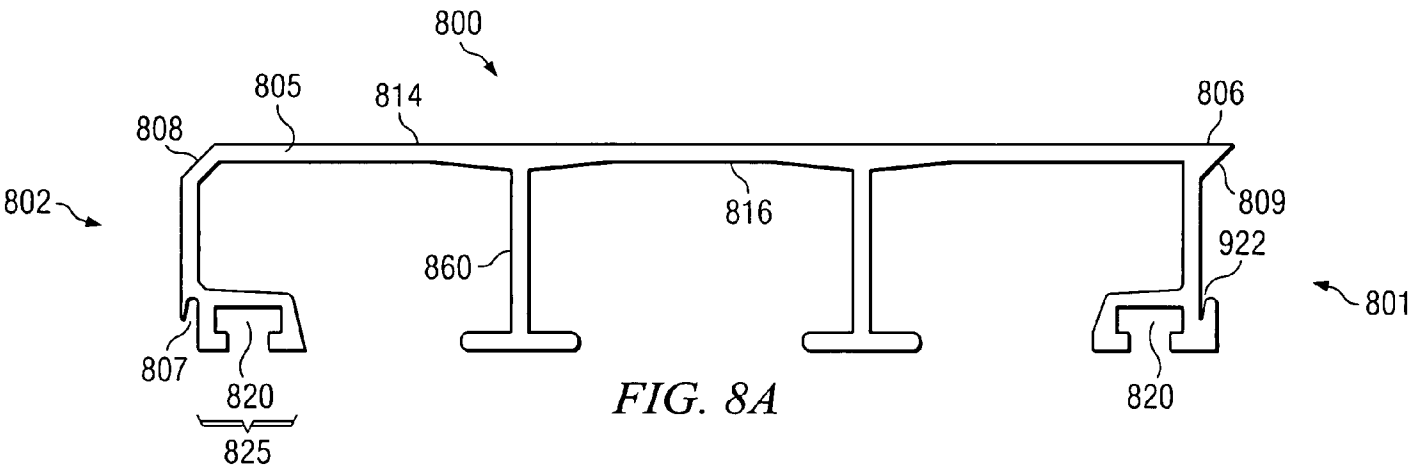
FIGS. 8A-8C show the cross-section of a pultruded sign panel.
Figure 8B:
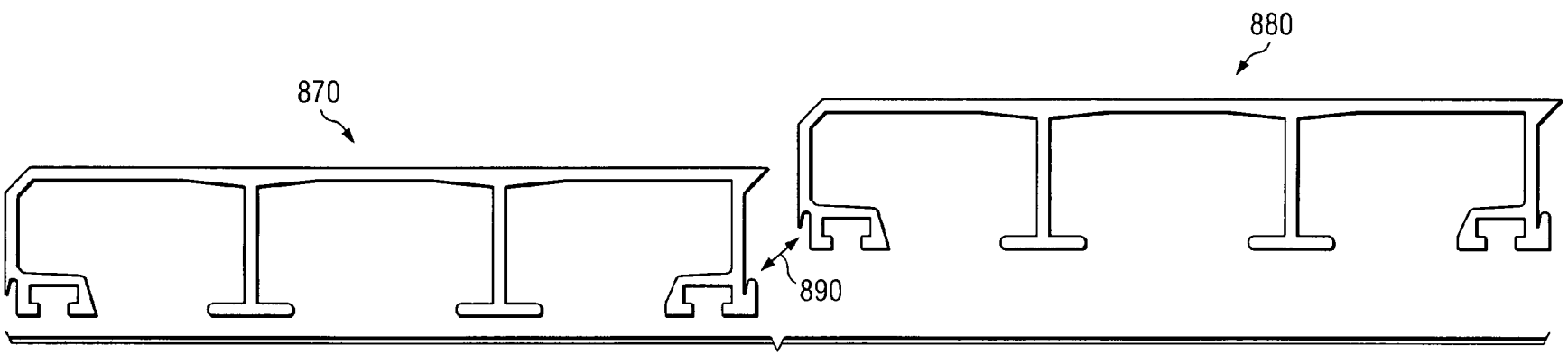
Figure 8C:
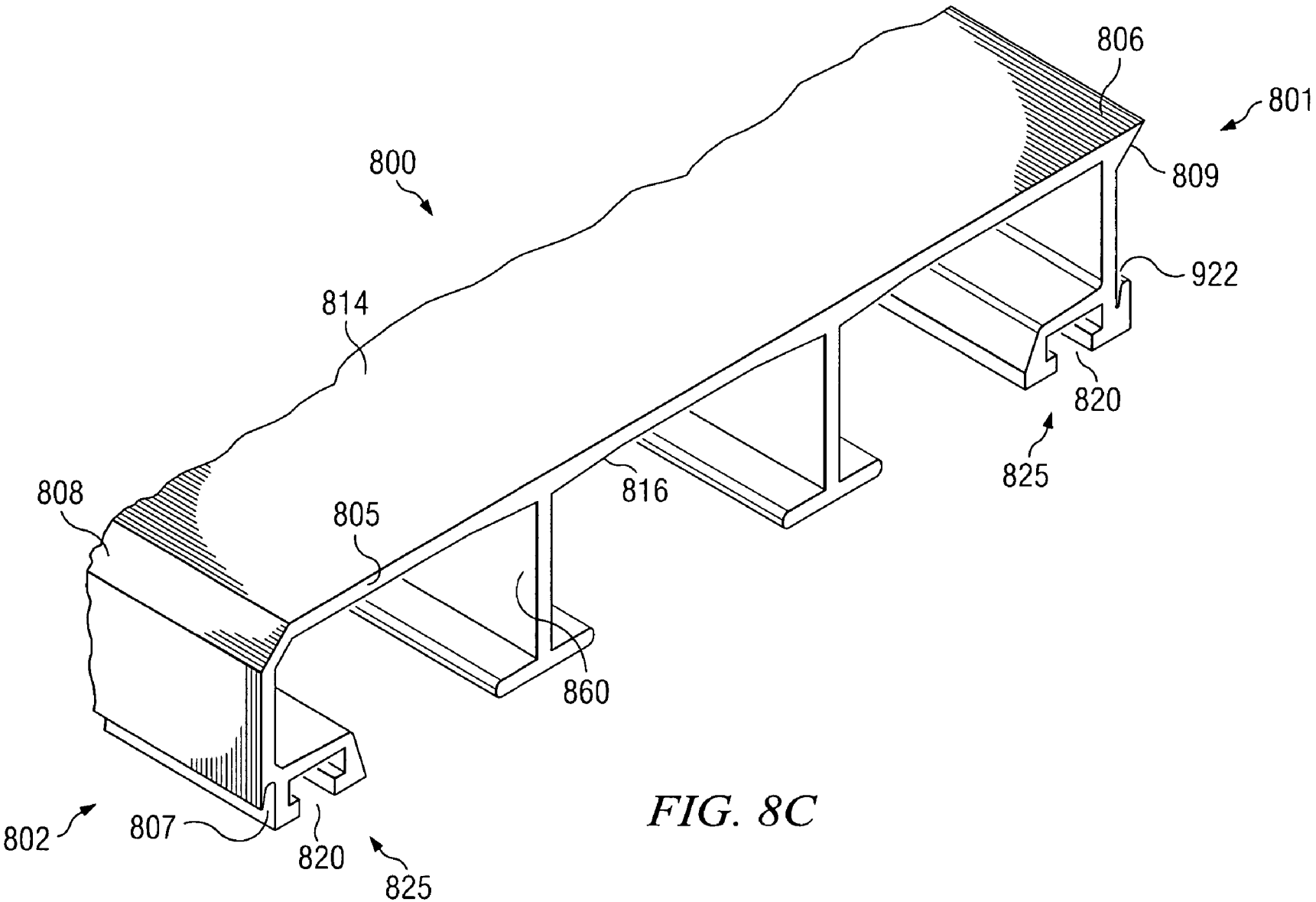

A fiberglass reinforced polymer ("FRP") highway panel having a cross section as shown in FIG. 8A allows more than one panel to be interconnected to another panel easily, as shown in FIG. 8B.

In a preferred embodiment, a FRP pultruded sign panel, as shown 800 in FIG. 8A, is one panel of the modular system for forming a sign blank in accordance with this invention. Multiple modular sign panels would be provided and joined together to form as large a sign blank as shown in FIG. 8B. A cross section of a preferred FRP pultruded sign panel blanks can be produced in different widths without deviating from the spirit and scope of the current invention. FIG. 8A shows a cross-section of a pultrusion panel having two mounting or fastener channels 820, which can be produced in different widths (e.g. 6, 12, 24, or 36 inches in width). Alternatively, the pultrusion panel having a single mounting or fastener channel 820, is also an embodiment of the invention without deviating from the spirit and scope of the invention, such panels can also be produced in different widths (e.g. about 3-36 inches in width). FIG. 8B shows how the design of the two cross-section can be used to form two interlocking pultrusion panels with mounting or fastening channels.

Modular panel 200 is preferably formed from resin reinforced plastic. The cross-sectional shape of modular panel 800, as shown in the figures and described herein, is achieved through a pultrusion method. The figures and the description herein are sufficient for providing those with ordinary skill in the art with enough knowledge for forming the panel through the pultrusion method, as describe above. Modular panel 800 includes face portion having sign side 814 and mounting portion having a back side 816. The back side 816 is further defined by its perimeter having at least one fastener channel 820. The fastener channel 820 allows the assembled sign to be fastened to a sign post or other mounting bracket for highway display. Due to this configuration, one modular panel 870 is selectively joined to another modular panel 880 by an interlocking design 890, and can be further reinforced using bolts, rivets, adhesive, or another mechanical (e.g. screws, clamps, fasteners, etc), or chemical means (e.g. glue, adhesive, epoxy etc.) to secure one panel lengthwise to another panel forming a flat sign side, as shown in 215 in FIG. 2.

The interlocking modular panels in accordance with this invention are preferably formed using four interlocking design features 807, 808, 809, and 822, as shown in FIGS. 8A and 8B. Additionally, other known interlocking designs in the art are considered to be within the spirit and scope of the invention. In a particularly preferred embodiment, modules are provided with widths at 6", 12", 24" or 36". Panel reinforcement ribs 860 preferably extend from the backside of the panel to lend stability and rigidity to face portion 814.

EXAMPLE 4

Figure 9A:
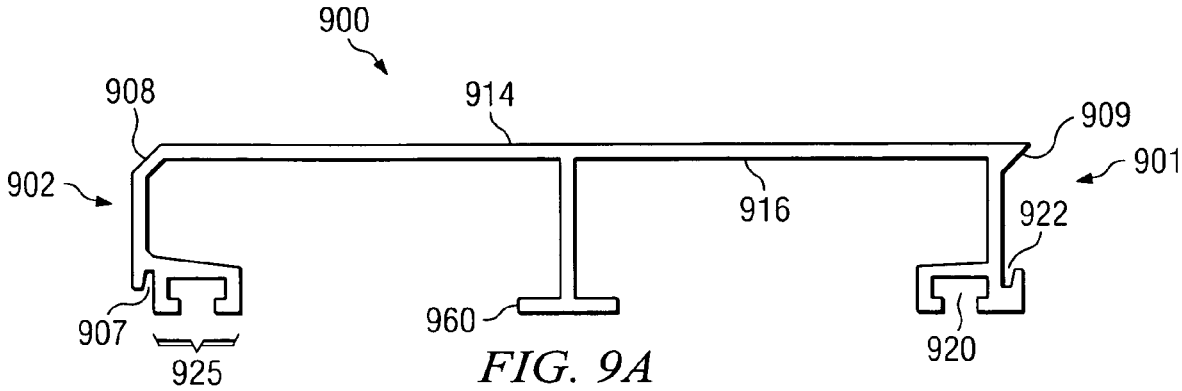
FIGS. 9A-9D show the cross-section of a pultruded sign panel.
Figure 9B:
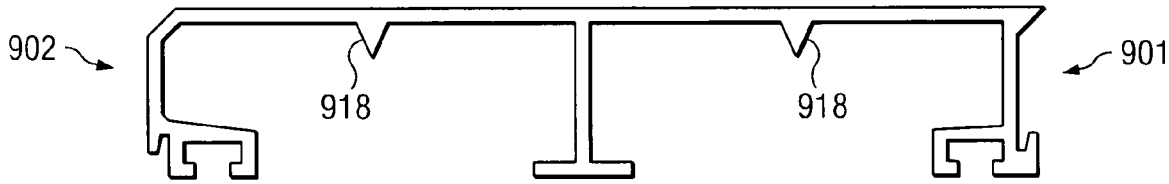

A fiberglass reinforced polymer ("FRP") highway panel having a cross section as shown in FIG. 9A, which has less panel reinforcement ribs 960 than shown in FIG. 8A. In contrast, the number of panel reinforcement ribs can be increased and are encompassed within the spirit and scope of the invention. Alternatively, partial panel reinforcement ribs 918 can be utilized to support the panel, as shown in FIG. 9B.

In a preferred embodiment, a FRP pultruded sign panel, as shown 900 in FIG. 9A, is one panel of the modular system for forming a sign blank in accordance with this invention. A cross section of a preferred FRP pultruded sign panel blanks can be produced in different widths without deviating from the spirit and scope of the current invention. FIG. 9A shows a cross-section of a pultrusion panel having two mounting or fastener channels 920, which can be produced in different widths (e.g. 6, 12, 24, or 36 inches in width). Alternatively, the pultrusion panel having a single mounting or fastener channel 920, is also an embodiment of the invention without deviating from the spirit and scope of the invention, such panels can also be produced in different widths (e.g. about 3-36 inches in width).

Modular panel 200 is preferably formed from resin reinforced plastic. The cross-sectional shape of modular panel 900, as shown in the figures and described herein, is achieved through a pultrusion method. The figures and the description herein are sufficient for providing those with ordinary skill in the art with enough knowledge for forming the panel through the pultrusion method, as describe above. Modular panel 900 includes face portion having sign side 914 and mounting portion having a back side 916. The back side 916 is further defined by its perimeter having at least one fastener channel 920. The fastener channel 920 allows the assembled sign to be fastened to a sign post or other mounting bracket for highway display. Due to this configuration, one modular panel 970 is selectively joined to another modular panel 980 by an interlocking design 990, and can be further reinforced using bolts, rivets, or another means to secure one panel lengthwise to another panel forming a flat sign side, as shown in 215 in FIG. 2.

The interlocking modular panels in accordance with this invention are preferably formed using three interlocking design features 907, 908, 909, and 922, as shown in FIG. 9A, however other known interlocking designs in the art are considered to be within the spirit and scope of the invention. In a particularly preferred embodiment, modules are provided with widths at 6", 12", 24" or 36". Panel reinforcement ribs 960 preferably extend from the backside of the panel to lend stability and rigidity to face portion 914.

Figure 10:
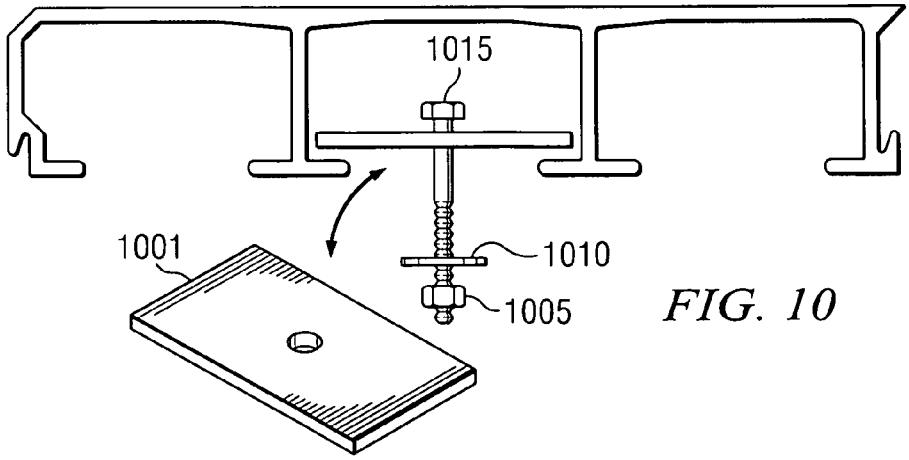
FIG. 10 shows a cross-section of an interlocking pultrusion panel having two full length reinforcement ribs.
Figure 9C:
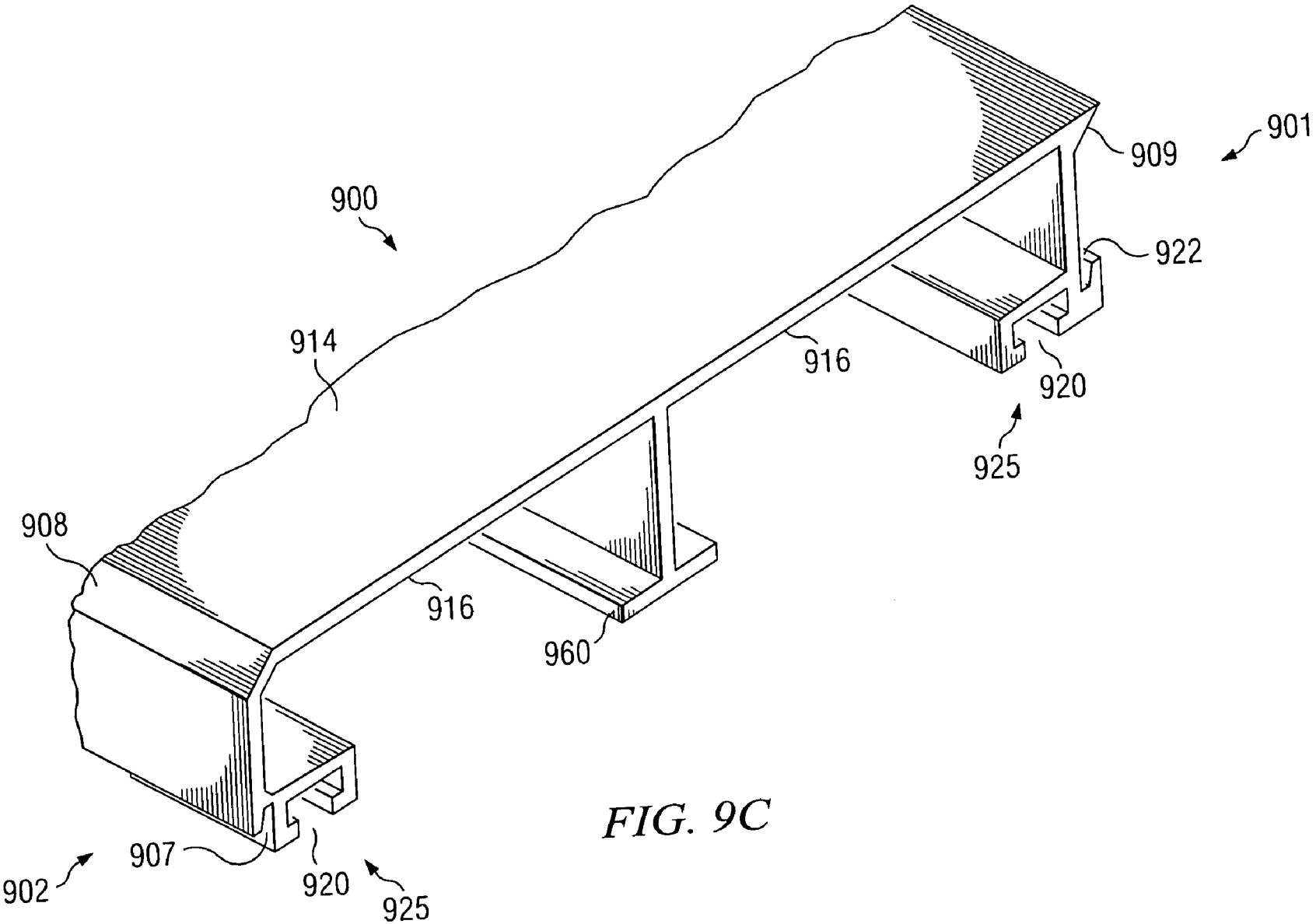
Figure 9D:
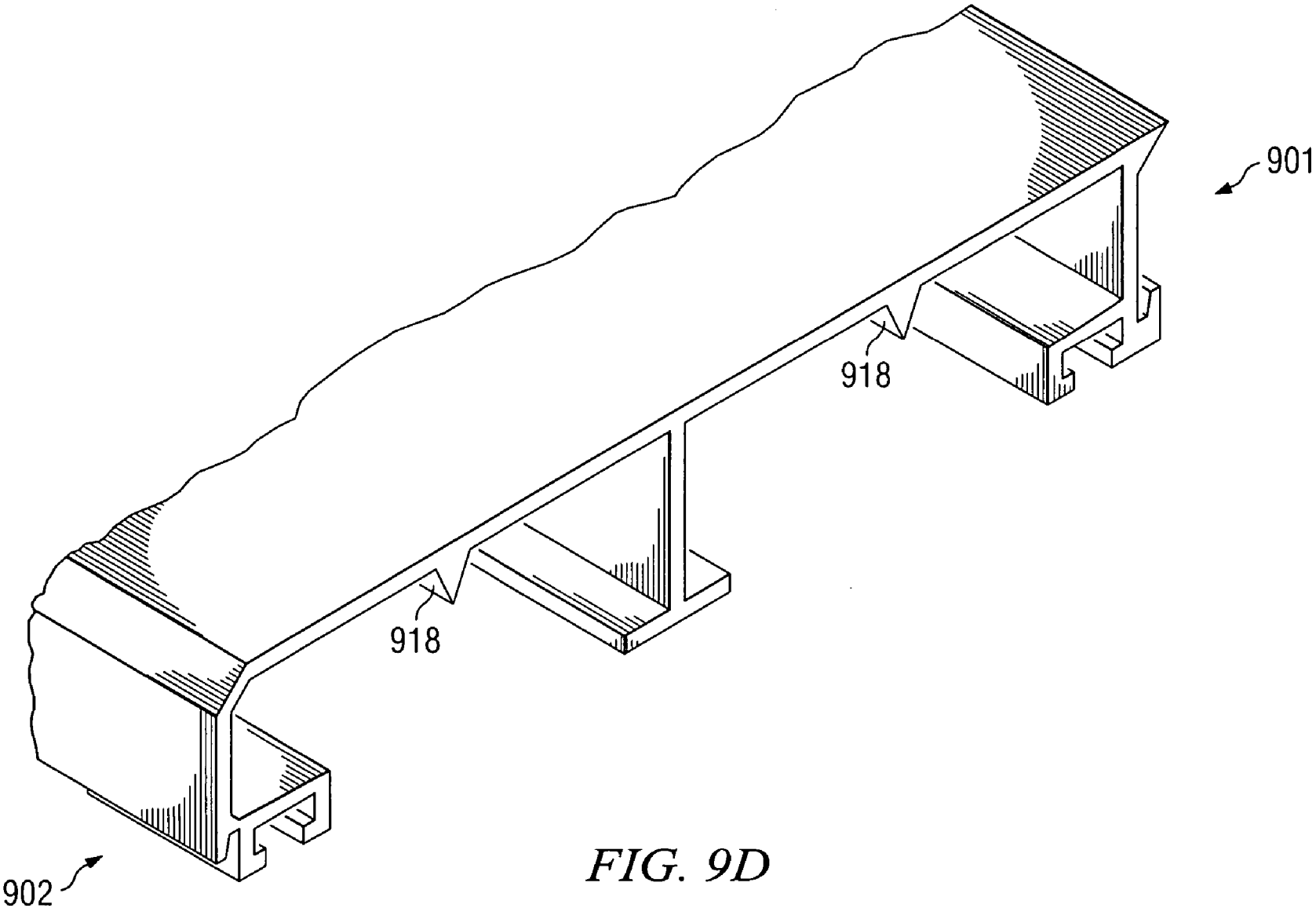

An alternative interlocking modular panels in accordance with this invention are preferably formed using the interlocking design features as shown in FIG. 10 and fastened to a sign post using an insert hold down 1001 with a bolt 1015, washer 1010, and a nut 1005 assembly.

With a sign blanks assembled from the modules as stated above, the sign may be completed by the attachment of a reflective coating or cover sheet upon the aligned face portions 214, or 215 of the individual or interconnected panels. Such attachment may be made by a mechanical, chemical, or other appropriate adhesive means. The completed sign blank is capable of being retrofit to the same fastening devices on the mounting structure as the prior art aluminum signs.

More specifically, a multi-panel system for making a sign blank, is comprised of a plurality of pultruded fiberglass sign panels having (a) a sign side (b) a back side; (c) a first channel end protruding from a first edge of the backside; (d) a second channel end protruding from a second edge of the backside; and (e) a mounting channel extending from the first channel end or second channel end. The first channel end of a first sign panel is fastened substantially adjacent to a second sign panel. The two sign panels are connected lengthwise along the second edge of the first channel end and the first edge of the second channel end forming a substantially flat sign surface on one side of the multi-panel system and a mounting surface on the opposite side of the substantially flat sign surface. In other preferred embodiments, the multi-panel system for making a sign blank also contains at least one reinforcing rib extending outwardly from the backside of the first or second sign panel. In a second preferred embodiment a first interlocking face extending outwardly from the first channel end; and a second interlocking face extending outwardly from the second channel end are used to join the panels. For example, the second interlocking face on the first sign panel can engage the first interlocking face on the second sign panel to couple the first and second sign panels together.

As compared to what are currently used, advantages of having the pultruded fiberglass sign panel system of the present invention include: (1) less expensive to manufacture; (2) lighter in weight; (3) more tensile strength; (4) less expansion and contraction in heat and cold; (5) more color option; and (6) utilize recycled or virgin starting material.

One skilled in the art readily appreciates that this invention is well adapted to carry out the objectives and obtain the ends and advantages mentioned as well as those inherent therein. Thus, it should be evident that the modular system and process of the present invention substantially improves the art of sign blanks. The compositions, methods, procedures and techniques described herein are presently representative of the preferred embodiments and are intended to be exemplary and are not intended as limitations of the scope. Changes therein and other uses will occur to those skilled in the art which are encompassed within the spirit of the invention or defined by the scope of the pending claims.

REFERENCES CITED

The following references, to the extent that they provide exemplary procedural or other details supplementary to those set forth herein, are specifically incorporated herein by reference.

U.S. Patent Documents

U.S. Pat. No. 4,394,338 issued to Fuwa on Jul. 19, 1983, titled "Production of Elongated Fiber-Reinforced Composite Articles."

U.S. Pat. No. 4,540,737 issued to Wissbrun, et al., on Sep. 10, 1985, titled "Method for the Formation of Composite Articles Comprised of Thermotropic Liquid Crystalline Polymers and Articles Produced Thereby."

U.S. Pat. No. 4,541,884, issued to Cogswell, et al., on Sep. 17, 1985, titled "Method of producing fibre-reinforced composition."

U.S. Pat. No. 4,559,262, issued to Cogswell, et al., on Dec. 17, 1985, titled "Fibre Reinforced Compositions and Methods for producing such Compositions."

U.S. Pat. No. 6,796,097, issued to Fensel, et al., on Sep. 28, 2004, titled "Roof or Wall Panel System and Method of Installation."

U.S. Pat. No. 6,872,273, issued to Davies, et al., on Mar. 29, 2005, titled "Method of Making a Pultruded Part with a Reinforcing Mat."

U.S. Pat. No. 3,034,806 issued to Squires, on May 15, 1962, titled "Digit Displays."

What is claimed is:

1. A multi-panel system for making a sign blank having a mounting surface, comprising:

at least a first and a second pultruded fiberglass sign panels, each panel having:

(a) a sign side having a substantially flat and continuous sign surface and having a first end and a second end;

(b) a back side having a first edge and a second edge that are parallel and located on opposite ends of the back side, wherein the first end of the sign side extends outwardly past the first edge of the back side to form an angled protrusion, and wherein the second end of the sign side is shaped to have an angled notch of dimensions corresponding to the angled protrusion;

(c) a first channel end protruding outwardly from the first edge of the back side forming an angle of about 90° with the back side, wherein a distal end of the first channel protrusion is furthest away from the back side;

(d) a second channel end protruding outwardly from the second edge of the back side forming an angle of about 90° with the back side, wherein a distal end of the second channel protrusion is furthest away from the back side; and (e) at least one mounting channel extending inwardly from the distal end of at least one of the first channel end or second channel end of the first or second pultruded fiberglass panel;

wherein, the first channel end of the first pultruded fiberglass sign panel is fastened substantially adjacent to the second pultruded fiberglass sign panel; the first and the second pultruded fiberglass sign panels are connected lengthwise along the second edge of the first channel end of the first pultruded fiberglass sign panel, wherein the angled protrusion of the first end of the sign side of the first pultruded fiberglass sign panel overlaps the angled notch of the sign side of the second pultruded fiberglass sign panel, forming the substantially flat and continuous sign surface on the sign side of the multi-panel system and forming the mounting surface on the distal ends of the first and second channel protrusions, wherein the overlap of the angled protrusion and the angled notch create a non-perpendicular hidden seam between the sign panels at the sign side, wherein the first or second pultruded fiberglass sign panel comprises a first interlocking face extending outwardly from the first channel end and a second interlocking face extending outwardly from the second channel end, wherein the first and second interlocking faces are substantially perpendicular to the sign surface, wherein the second interlocking face on the first sign panel can engage the first interlocking face on the second sign panel to fully couple the first and second sign panels together such that additional connection between the panels is not required a wherein the at least one mounting channel has an inner periphery that forms an empty space enclosed on three sides for attachment to a post or mounting bracket to display the sign blank, and wherein the at least one mounting channel permits the sign blank to be retrofit to existing fastening devices on the post or mounting bracket of highway signs.

2. The multi-panel system for making a sign blank of claim 1, wherein the at least one mounting channel is a mounting channel extending inwardly from the distal end of the first channel end of the first or second pultruded fiberglass sign panel.

3. The multi-panel system for making a sign blank of claim 1, wherein the at least one mounting channel is a mounting channel extending inwardly from the distal end of the second channel end of the first or second pultruded fiberglass sign panel.

4. The multi-panel system for making a sign blank of claim 1, further comprising a reinforcing rib extending outwardly from the back side of the first or second pultruded fiberglass sign panel.

5. The multi-panel system for making a sign blank of claim 1, further comprising a connector for connecting the first sign panel to the second sign panel comprising: a bolt, a clamp, a rivet, a screw, a weld, a latch, glue, fastener, adhesive, or a combination thereof.

6. The multi-panel system for making a sign blank of claim 1, wherein the first or second pultruded fiberglass sign panel is constructed from a list of materials comprising:

(a) a glass roving;

(b) a glass reinforcement mat; and (c) a resin matrix;

wherein a glass content comprises an amount of glass contained in both the glass roving and the glass reinforcement mat.

7. The multi-panel system for making a sign blank of claim 6, wherein the glass content of the sign blank is about 56% to about 58% by weight or about 38% to about 40% by volume.

8. The multi-panel system for making a sign blank of claim 6, wherein the glass content of the sign blank comprises about 16% by weight or 35% by volume of recycled or virgin glass.

9. The multi-panel system for making a sign blank of claim 6, wherein a resin matrix of the sign blank comprises about 5% to about 50% of a recycled or virgin resin matrix.

10. The multi-panel system for making a sign blank of claim 1, wherein the width of the multi-panel system is in a range of about 1 foot to about 50 feet.

11. The multi-panel system for making a sign blank of claim 1, wherein the length of the multi-panel system is in a range of about 1 foot to about 50 feet.

12. A method for: forming a multi-panel sign blank from modular sign panels of pultruded fiberglass, comprising:

(a) selecting a first sign panel and a second sign panel of pultruded fiberglass, wherein the first and second sign panels each comprises: a sign side having a first end and a second end: a back side; a first channel end protruding from a first edge of the back side; a second channel end protruding from a second edge of the back side. wherein the first end of the sign side extends outwardly past the first edge of the back side to form an angled protrusion, and wherein the second end of the sign side is shaped to have an angled notch of dimensions corresponding to the angled protrusion; and a mounting channel extending from the first channel end or second channel end, wherein the mounting channel has an inner periphery that forms an empty space enclosed on three sides for attachment to a post or mounting bracket to display the sign blank, and wherein the at least one mounting channel permits the sign blank to be retrofit to existing fastening devices on the post or mounting bracket of highway signs;

(b) fastening the first sign panel to the second sign panel by contacting a first interlocking face extending outwardly from the first channel end of the first sign panel to a second interlocking face extending outwardly from the second channel end of the second sign panel, wherein the first and second interlocking faces are substantially perpendicular to the sign side, wherein the angled protrusion of the first end of the sign side of the first sign panel overlaps the angled notch of the sign side of the second sign panel and wherein the overlap of the angled protrusion and the angled notch create a non-perpendicular hidden seam between the sign panels at the sign side; wherein second interlocking face on the first sign panel can engage the first interlocking face on the second sign panel to fully couple the first and second sign panels together lengthwise along the second edge of the first channel end of the first panel and the first edge of the second channel end of the second panel such that additional connection between the panels is not required, forming a substantially fiat and continuous sign surface on one side of the multi-panel system and a mounting surface on the opposite side of the substantially fiat sign surface.

13. The method of claim 12, further comprising selecting a first or second sign panel to have a reinforcing rib extending outwardly from the back side of the first or second sign panel.

14. The method of claim 12, further comprising selecting the first or second sign panel to be constructed from a list of materials comprising:

(a) a glass roving;

(b) a glass reinforcement mat; and (c) a resin matrix;

wherein a glass content comprises an amount of glass contained in both the glass roving and the glass reinforcement mat.

15. The method of claim 14, further comprising selecting the glass content of the sign blank to be about 56% to about 58% by weight or about 38% to about 40% by volume.

16. The method of claim 14, further comprising selecting the glass content of the sign blank to be about 16% by weight or 35% by volume of recycled or virgin glass.

17. The method of claim 14, further comprising selecting a resin matrix of the sign blank to be about 5% to about 50% of a recycled or virgin resin matrix.

18. The method of claim 14, further comprising selecting the width of the multi-panel sign blank to be in a range of about 1 foot to about 50 feet.

* * * * *